US007784131B2

(12) United States Patent
Genaro et al.

(10) Patent No.: US 7,784,131 B2
(45) Date of Patent: Aug. 31, 2010

(54) DISTRIBUTED PRESSURE CONTROL FOR SUPPORT SURFACES

(75) Inventors: David M. Genaro, North Lauderdale, FL (US); Lydia B. Biggie, Lighthouse Point, FL (US); Marco A. Paez, Lantana, FL (US)

(73) Assignee: Anodyne Medical Devices, LLC, Los Angeles, CA (US)

( * ) Notice: Subject to any disclaimer, the term of this patent is extended or adjusted under 35 U.S.C. 154(b) by 486 days.

(21) Appl. No.: 11/851,880

(22) Filed: Sep. 7, 2007

(65) Prior Publication Data

US 2009/0064418 A1 Mar. 12, 2009

(51) Int. Cl.
*A61G 7/057* (2006.01)
*A47C 27/10* (2006.01)

(52) U.S. Cl. ..... 5/713; 5/710; 5/715

(58) Field of Classification Search ..... 5/615, 5/710, 713, 715
See application file for complete search history.

(56) References Cited

U.S. PATENT DOCUMENTS 4,797,962 A * 1/1989 Goode ..... 5/713
4,989,283 A * 2/1991 Krouskop ..... 5/713
4,993,920 A * 2/1991 Harkleroad et al. ..... 417/44.2
5,170,364 A * 12/1992 Gross et al. ..... 702/139
5,794,288 A 8/1998 Soltani et al.
5,904,172 A * 5/1999 Gifft et al. ..... 137/224
6,108,843 A * 8/2000 Suzuki et al. ..... 5/713
6,367,106 B1 4/2002 Gronsman
7,036,171 B2 * 5/2006 Wu ..... 5/713
7,219,380 B2 5/2007 Beck et al.
2003/0079292 A1 5/2003 Ellis et al.

* cited by examiner

*Primary Examiner*—Michael Trettel
(74) *Attorney, Agent, or Firm*—Nixon & Vanderhye P.C.

(57) ABSTRACT

A distributed pressure control system for a support surface includes a main controller including a source of pressurized air and a communication interface, and an air manifold having an air inlet coupled with the air source and a plurality of air outlets. A plurality of control modules are each attachable to a respective one of the plurality of air outlets. Each control module includes at least one valve and includes a control unit communicating with the communication interface. The control modules effect inflation and deflation of air cells in the support surface via the valves based on a signal from the communication interface.

13 Claims, 3 Drawing Sheets

DISTRIBUTED PRESSURE CONTROL FOR SUPPORT SURFACES

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The invention relates to a support surface and, more particularly, to a support surface such as a mattress or the like and a control system that effects pressure distribution to air cells that define the support surface.

Support surfaces are widely used in medical facilities and at home to provide pressure relief for immobile patients. These devices provide treatment for the prevention and cure of decubidus ulcers (bed sores) or pressure wounds. For any support surface that is an air or fluid support surface, the pressure in the air cells is controlled by some sort of valves, typically solenoid valves, or rotating valves. These valves allow air or other fluid into and out of the cells. For any one zone (i.e., the pressures are the same in those air cells), at least one, preferably two, valves allow the air to flow in or out of the air cells. Since the human body's weight is not evenly distributed (for instance, the torso zone is heavier than the foot zone), the pressures required in these zones differ. Therefore, it is not uncommon to require many valves to properly control various zones in the mattress.

Typically all these valves are located in the controller, which also houses the pump, control PC boards, tubing connections and other various mechanisms. For optimum therapy, many zones are required, which therefore require many valves and many connecting hoses. The size and the weight of the controller increases as the zone requirement increases. This in turn makes the placement of a large and heavy controller on the footboard of a hospital bed difficult. It also requires a unique controller for a unique zoned mattress as each valve assembly or valve manifold is unique to each zoned mattress.

BRIEF SUMMARY OF THE INVENTION

It would thus be desirable to eliminate the valves and other control mechanisms in the controller, and place them instead in a small module at each air cell or groups of air cells inside the mattress. This allows for a universal valve module to be used over a wide variety of support surfaces.

In an exemplary embodiment, a distributed pressure control system for a support surface includes a main controller including a source of pressurized fluid, preferably air, and a communication interface, and a fluid manifold having a fluid inlet coupled with the fluid source and a plurality of fluid outlets. A plurality of control modules are each attachable to a respective one of the plurality of fluid outlets, where each control module includes at least one valve and includes a control unit communicating with the communication interface. The control modules effect inflation and deflation of cells in the support surface via the valves based on a signal from the communication interface.

Each of the control modules may additionally include at least one pressure sensor. In this context, the control unit may include a processor communicating with the main controller via the communication interface and communicating with the at least one valve and the pressure sensor, where the control unit controls the at least one valve to inflate or deflate a respective one or a respective group of the cells in the support surface based on the signal from the communication interface and a pressure detected by the pressure sensor.

The at least one valve may be one of a solenoid valve or a rotary valve. The valve preferably includes an injection-molded housing. The valve may be a 2-way valve or a 3-way valve.

The main controller may additionally include a user interface enabling operator control of distributed pressure.

In another exemplary embodiment of the invention, a mattress includes a plurality of cells connected together to define a support surface, at least two of the cells being independently inflatable and deflatable; and the distributed pressure control system. The control system may include a control module for each of the cells or alternatively, a control module for each group of the cells, wherein each of the cells or group of cells is independently inflatable and deflatable. Each of the control modules may identify a location of its respective cell to the main controller.

In yet another exemplary embodiment, a distributed pressure control system for a support surface including a plurality of cells includes a universal controller disposed outside of the support surface and housing a source of pressurized fluid and a communication interface; and a plurality of control modules disposed inside the support surface, each of the control modules receiving pressurized fluid from the universal controller and being attached to a respective one or a respective group of the cells, wherein the control modules effect inflation and deflation of the cells based on a signal from the communication interface. The universal controller may include a memory storing data relating to support surface types and cell group configurations, wherein the universal controller is programmed to identify the support surface type when connected based on signals from the control modules. The universal controller may further be programmed with predefined zone control settings selectable by a user.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
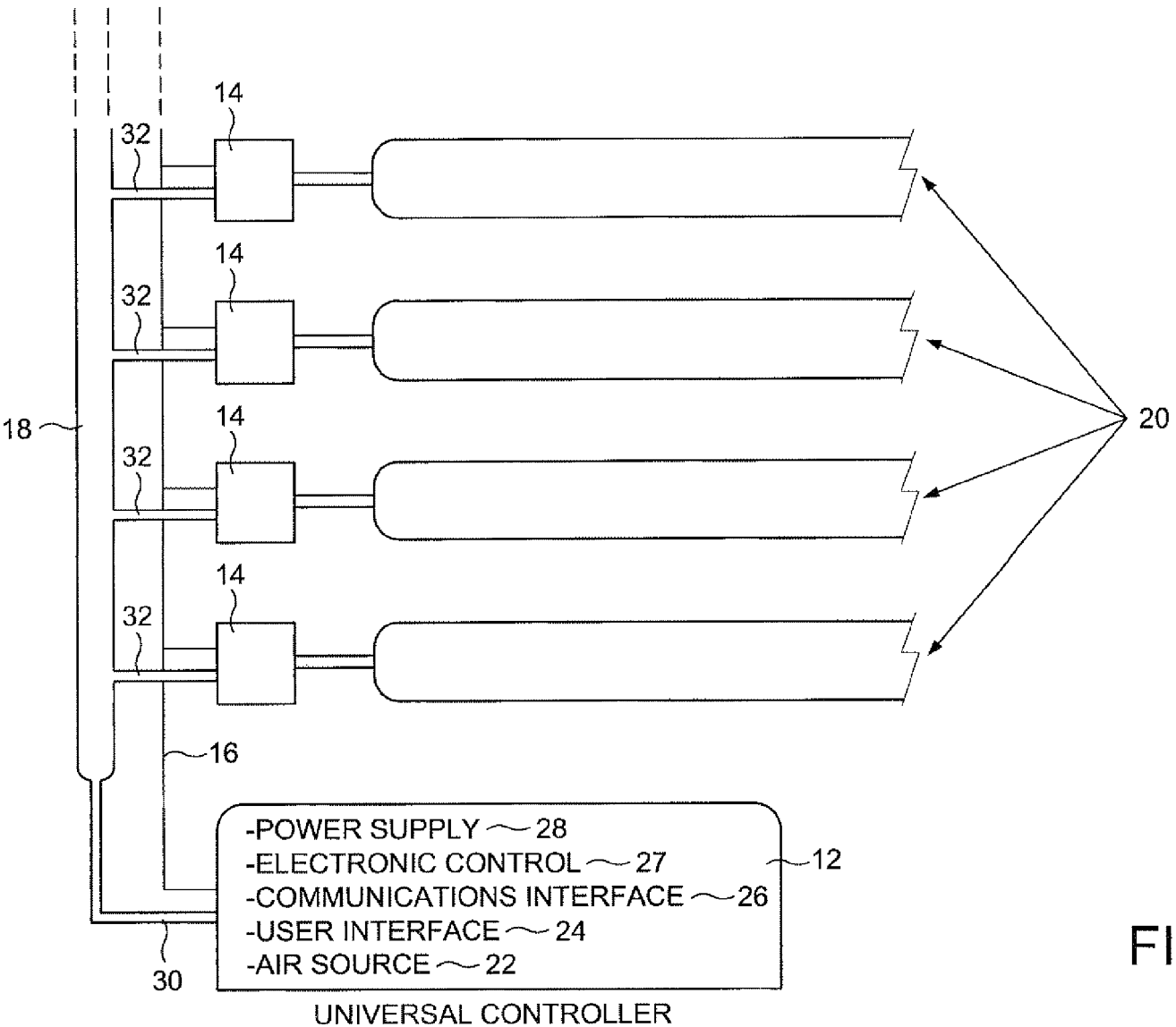
FIG. 1 is a schematic drawing of an embodiment of a distributed pressure control system.

FIG. 1 is a schematic illustration of an exemplary embodiment. A main or universal controller 12 is connected with a plurality of control modules 14 via a communication line 16 and a manifold 18. Each of the control modules 14 is connected with one or more air cells 20 that together define a support surface.

Figure 2:
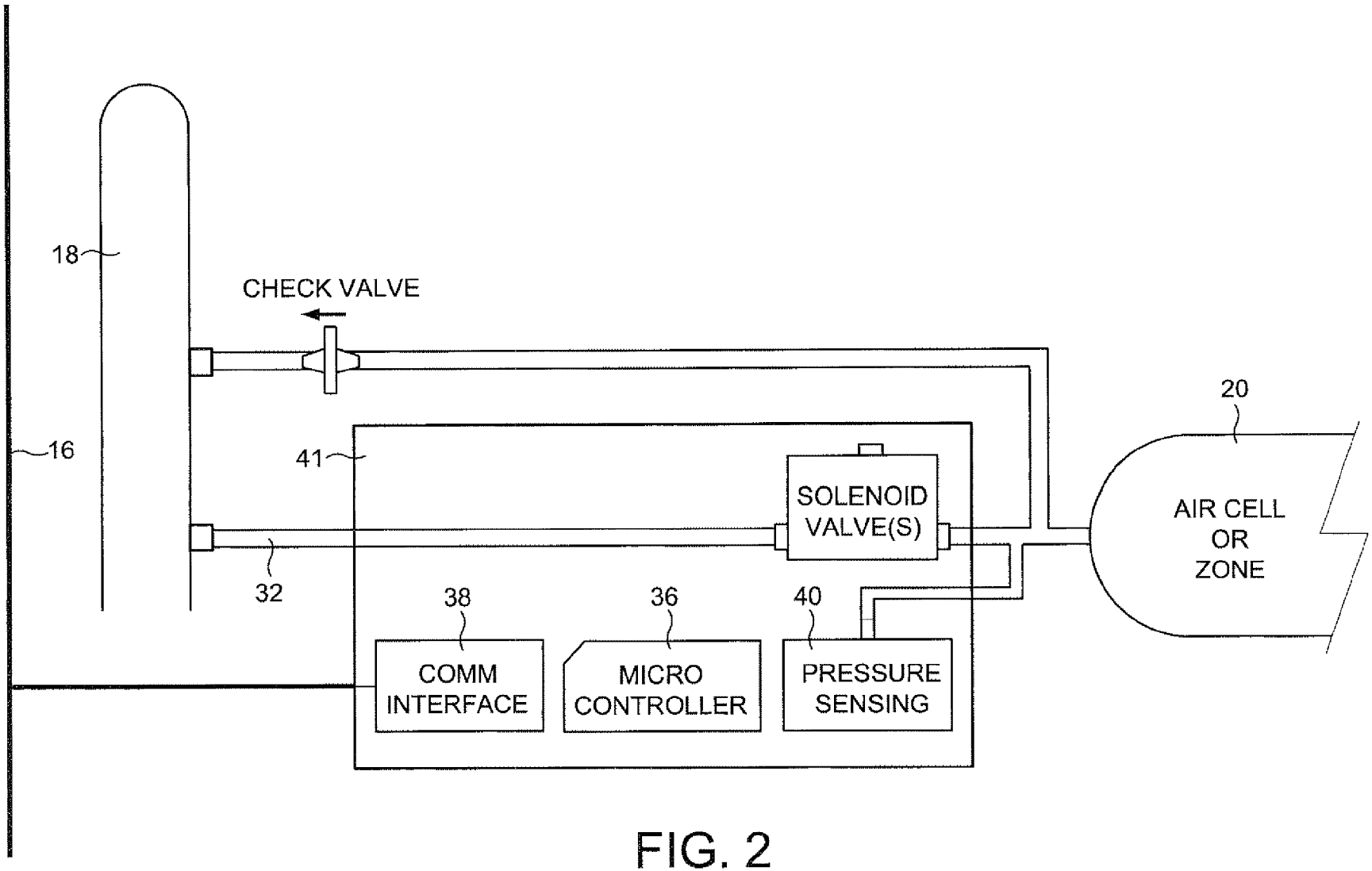
FIG. 2 is a schematic drawing of a control module used with the distributed pressure control system.

The main controller 12 includes a source of pressurized air 22, a user interface 24, a communication interface 26, and a power supply 28. The manifold 18 includes an air inlet 30 coupled with the air source 22 and a plurality of air outlets 32. With reference to FIG. 2, the control modules 14 each include at least one valve 34 and a control unit 36 having a communication interface 38 communicating with the communication interface 26 of the main controller 12 via the communication line 16. The control modules 14 may also include a pressure sensor 40. The control modules 14 effect inflation and deflation of the cells 20 in the support surface via the valves 34 based on a signal from the communication interface 26 and based on a reading by the pressure sensor 40 if included. The manifold 18 may also function as a mini reservoir for the air cells 20. By making the manifold 18 large enough to accommodate some volume of air and at a pressure higher than the normal pressure in the air cells 20, it allows for immediate and rapid air venting into the air cell 20 once the valve 34 is opened. Once the air cells 20 are filled, the air source or pump 22 has plenty of time to refill the manifold 18 to its original high pressure. This avoids all the air coming from the air source 22, along the full length of the manifold 18 if the manifold were just tubing.

The control modules 14 house their respective components in a potted or otherwise sealed small container or plastic box 41. Each cell or zone (including several cells) 20 preferably include one control module 14. The modules 14 are connected to the manifold 18, which is preferably a single hose running down a length of the support surface or a long cell running down the length of the support surface.

The valves 34 may be standard off the shelf 2-way or 3-way solenoid valves. The valves 34 are designed to handle the relatively low pressures used in support surfaces. For example, pressures less than 1 psi are not uncommon. The valves 34 are also provided with sufficiently large ports so as not to constrict the flow of air of other fluid into the cell 20.

Figure 3:
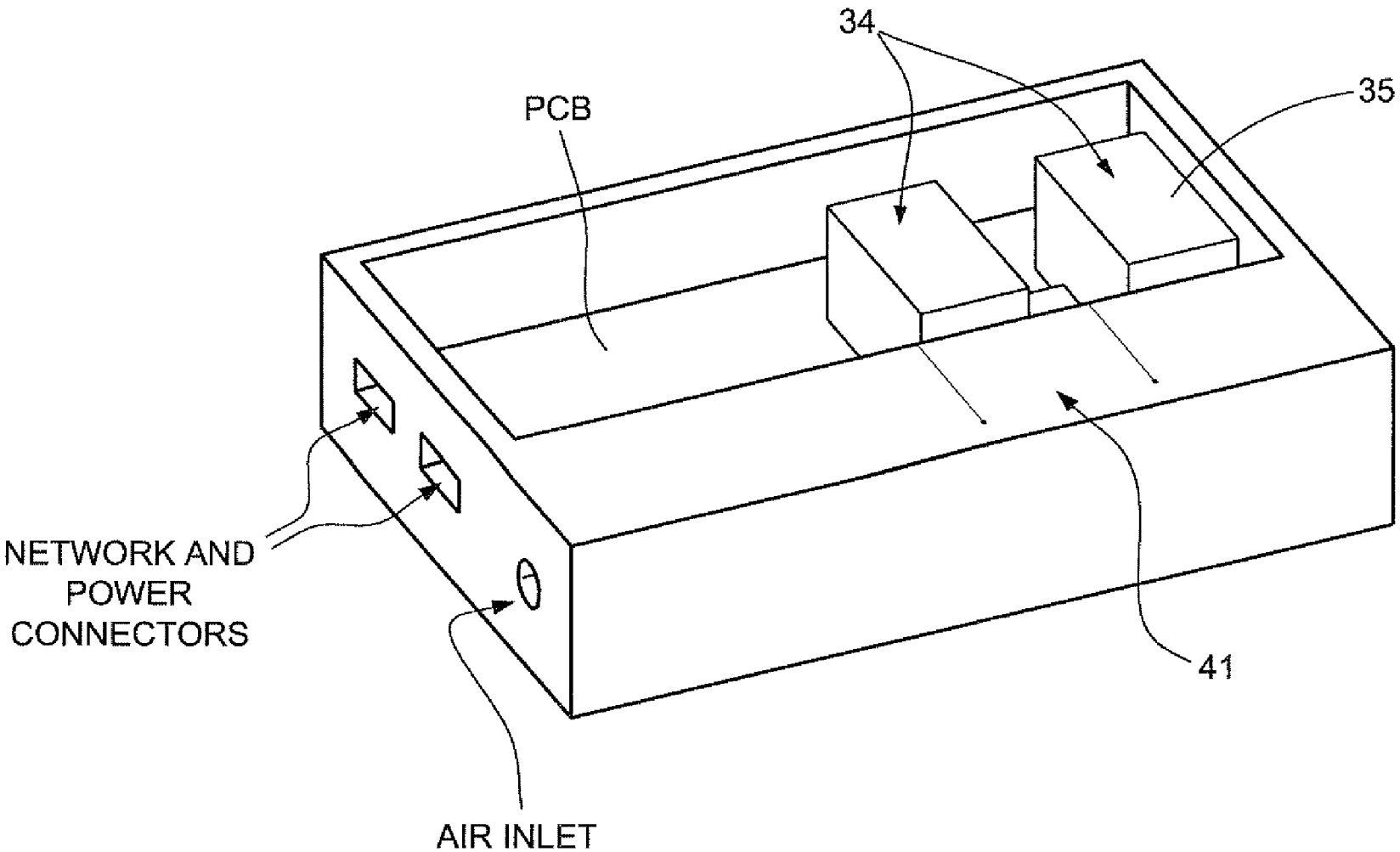
FIG. 3 shows a control module housing also serving as a valve housing.

Commercially available solenoid valves are relatively expensive since they use machined brass and stainless due to the high pressures (i.e., 50 psi, or 100 psi) they are designed to withstand. Support surfaces do not use such high pressures, and therefore these valves are "over designed." A simple rotary valve could be used, however, there are usually fewer variations of control with this type of valve, and they have tendency to leak over time. These valve are relative inexpensive, however, as many are made of injection molded plastic. With reference to FIG. 3, to further reduce cost, it is possible to incorporate a plastic injection molded housing 35 of the solenoid valve 34 into a plastic housing 41 for the control module 14. The valve components would snap into a seat in the plastic valve housing. This way only one injection mold would be required and would also reduce assembly time.

A preferable type of solenoid valve 34 is an injection-molded valve. The valve body is plastic with a simple neoprene type seat utilized by the plunger with a spring. Commercially available coils can also be used. This allows for an inexpensive, small and lightweight valve to be manufactured while allowing for large port openings. This valve could be 2-way and used in pairs. These valves are normally closed. A 3-way valve may alternatively be utilized and could be normally open. Of course, other variations could be used.

If normally closed valves are utilized, in the event of a power failure, extra devices would be required in order to evacuate the mattress (if necessary to perform CPR on the patient, which requires the mattress to be firm, and therefore deflated and flat on the bed frame). In this context, the valves 34 may also include a battery backup to activate a CPR function when the power is out. With the power out, and normally closed valves, no air or other fluid would escape the cell 20 via the valve 34, thus necessitating a battery power source to evacuate the air cells 20. Alternatively, a one way check valve may be provided at every module flowing from the air cell to the manifold, bypassing the solenoid valve. If the air pressure in the manifold is lower than the pressure in the air cell, the check valve would open, and air would escape from the air cell to the manifold. In normal operation the manifold, like a small reservoir, holds air and is maintained at a high pressure. The reservoir is then a ready source for high pressure air to go to the air cell. However, if power is interrupted, the solenoid valve remains closed, the air cell stays at pressure, but the manifold (mini-reservoir) would vent—i.e. lowering its pressure. As soon as the pressure in the air cell is higher than the manifold pressure, the check valve would open (reach its "cracking" pressure).

It is desirable to have as few valves (preferable just one) 34 as possible in the module 14 to reduce cost and size. A singular valve 34 allows passage of fluid from the hose 18 to the cell 20, and also allows fluid from the cell back into the valve to vent. Unlike a check valve, a solenoid valve in concert with a pressure sensor allows operation over the whole range of pressures.

The communication line 16 is preferably a 3-wire cable (power, ground, control) or a twisted pair, which is less susceptible to electronic noise, or any suitable cable used as communication from the modules 14 back to the main controller 12. The communication could also be accomplished through a wireless system or through fiber optics, as long as any of these systems can allow for a reliable flow of information to be sent between the modules 14 and the controller 12.

Information sent from the modules 14 to the controller 12 may include the pressure of the cell from the pressure sensors 40, a signal that the valve 34 is either open or closed or venting, or a location address of the cell or zone 20, etc. Information sent from the controller 12 to the modules 14 could be signals to change the valve settings from open to closed or vent, closed to open, or closed to vent, or commands or information to and from only specific address locations, etc.

Each module 14 also has the ability to be addressed for location. This address would be mapped to the physical location of each cell or zone 20 in the support surface. The location address allows for the control commands to be sent from the controller 12 to specific modules 14 and receive data back for the module 14. Addressing could be accomplished by a settable or programmable chip in each module, using DIP switches, jumper shunts, rotary switches, or by the physical order or position on the wire (token ring/daisy chains), or other suitable manual, automatic, mechanical or electronic means.

This location information is fed back along the communication cable 16 to the controller 12 and stored there. The controller 12 may display these locations of the zones for caregiver use. Almost any communication protocol could be used such as RS232, RS485, or RS 422. The protocol could be synchronous or asynchronous.

An advantage of attaching a location address to each module 14 is that it is very easy to change what is considered a 'zone' 20 simply through the micro-controller or programmed chip 36. Any combination of addresses can be used to define a zone, the addresses of each zone can be changed "on the fly." Prior to the present invention, zones were controller by the routing of the hoses, and changing that configuration was very difficult.

In addition to a PCB with microprocessors 27, power supply 28, and the pump or fluid source 22, the controller 12 also houses user interface components 24 including displays, control touch panels, or control knobs and switches for the caregiver to use. There are, of course, other electronic and electro-mechanical components in the controller 12 such as power cord sockets, on/off switches etc.

The plurality of valves with many barbed connections and connecting tubing or large valve manifolds are no longer required. This allows for a smaller and cooler controller. The many valves closely mounted together create heat inside the controller, which can cause long-term degradation to capacitors and other electronic components on PC boards. Fans are often utilized to keep the heat build up from the valves to a minimum. It is possible with the current embodiment to remove the fan from the controller, thereby further reducing costs. The many valves in a conventional controller are also about one half the total weight of the controller, so the design described herein will be lighter in weight.

Significantly, the controller 12 can be a universal model for any mattress or support surface. Only the programmed microprocessor might differ in the controller. But even a "universally" programmed microprocessor could be utilized. A universally programmed controller, as a first step, could immediately be sent information from all the control modules in the mattress as to the number of modules and their location. This would then specify a particular program (i.e., the mattress is identified). This is an important first step as the zones, and therefore, the operation of a lateral rotation mattress, for example, is completely different than that of a 3-zone alternating pressure mattress.

Since the support surface requires only one hose or manifold 18, which connects to all the control modules 14, multiple hoses and their connections in current systems can be eliminated. It is not unusual in a conventional system to have six or more hose connections from the mattress to the controller for zoned mattresses. Of course, other hoses or manifold assemblies could be added if required. In any event, there would be fewer hoses and connections than the typical support surface.

Also, since there is already a communication wire running the length of the mattress, other devices, such as a tilt sensor could also be easily incorporated into the mattress. A tilt sensor allows for automatic adjustment of pressure when the patient is in a Fowler, seated, or upright position. Other sensors or alarms (for example out of bed alarm, heat sensor, weight sensors) could also be easily added, using the same communication cable 16 back to the main controller 12.

Examples of zone control are described below.

In a first example, zones of head, trunk and foot are very common. There may be more than three zones by adding zones for the left and right calf, heels, and shoulders. One or more zones could be defined via longitudinal cells along the side of the mattress for edge support. It is desirable to have these cells inflated while the patient is in the bed, but have the ability to deflate these cells for patient egress. Yet another exemplary zone may include two large cells on either side of the centerline of the mattress used for either lateral rotation therapy or a quick turn for nursing protocol. Still further, a zone could include all the cells used for a CPR rapid deflation application. With all the cells 20 connected electrically through the communication cable 16 to the controller 12, a simple button could be electrically activated that would open all the valves 34 and rapidly deflate the mattress.

For a power out situation, all cells (with the control module) may be programmed to interconnect, and a single manual pull could be used for a CPR deflation device.

A zone could include a low air loss feature, whether conventional with air porting into the mattress or with the system described in U.S. Pat. No. 5,926,884 including a low air loss distribution device through the top cover.

Zones could be used to distinguish between sections of the mattress that have alternating pressure (some cells are inflated while others are deflated on a cyclic basis) and those zones that are at constant low pressure (float or static). It would be possible to have one portion of the mattress have alternating pressure (say in the trunk which has a high susceptibility for skin breakdown), while the remaining portions of the mattress can be in a float or static mode for greater comfort.

This mattress could be zoned such that the control modules 14 control the fluid to give optimum "wave" therapy.

Each cell 20 could be an independent zone (perhaps 16 to 22 zones per mattress) for high-end therapy for the most critically ill.

With the air source reversed to serve as a vacuum pump, the cells 20 may alternatively or additionally be configured for a deflated state to relieve regions of highest pressure and better distribute the patient's weight across the cells 20. In this context, the cells capable of being contracted via vacuum may additionally include a core material such as a resilient foam or the like in order to provide additional support in the contracted state. Moreover, when the vacuum pressure is released, the core more quickly expands to a normal or relaxed state. Exemplary structure for such cells is disclosed in U.S. Pat. No. 6,367,106, the disclosure of which is incorporated by reference.

Zones for percussion therapy would benefit greatly from this device as the sensors are immediately at the air cell. This eliminates the sensor delay and drop of pressures typically found with sensors located in the controller at a distance from the air cells. Percussion depends on rapid inflation and deflation. This in turn depends on a high volume of air going into and out of the air cell rapidly. With the control module at the air cell, and preferably one large hose, the large volume of airflow is highly and immediately controllable.

A "zone" could be defined as any leaking air cell. With the described system, there may be a pressure sensor 40 at each cell or zone 20. If any one cell leaked, this drop in pressure would be transmitted to the controller 12. The controller 12 in turn could indicate the location of the leaky cell, greatly simplifying the trouble-shooting time of locating the leaky cell.

There are numerous other cells or combination of cells that could form separately controlled zones using the present system.

The use of a single universal controller for all variations of mattresses dramatically reduces costs and inventory requirements for suppliers of support surfaces. If there are modifications to the zones of a mattress, only the programmed microprocessor needs to be updated, if it is not already a "universally" programmed microprocessor. This keeps products current at minimal cost.

As the same control module is used for all mattress versions, the overall costs of valves for this system compared to unique valve assemblies of current systems is reduced. Purchasing and stocking one control module is far more cost effective than purchasing and stocking a variety of expensive valve assemblies.

Another advantage is the immediate and better control over pressures in the cells allowing for a greater variety of therapies. With the valve and pressure sensor located right at the cell, there is no delay in filling or venting the cell.

Also, this device greatly improves the ability to locate leaks in the cells, as each cell is addressed with a location. The leaking cell can be displayed with identification and location on the display of the controller.

Another benefit is the ability to custom set the pressures in many more zones than is typically possible today. This customizes the therapy for each patient. For instance, if a patient has heal breakdown, that exact location on the mattress can be set to extremely low pressures. The rest of the mattress can have normally set pressures avoiding bottoming out and offering standard therapy.

Another advantage is a greatly simplified hose assembly, especially for multi-zoned mattresses. In current designs, at least one hose is needed for each zone that connects the controller to the zone. A three zone alternating pressure mattress, for instance, requires six separate hose lines running from the controller to the mattress. With the present system, this can be reduced to one single, slightly larger hose, thereby reducing manufacturing costs.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A distributed pressure control system for a support surface, the control system comprising:

a main controller including a source of pressurized fluid and a communication interface;

a fluid manifold having a fluid inlet coupled with the fluid source and a plurality of fluid outlets; and a plurality of control modules, each attachable to a respective one of the plurality of fluid outlets, each control module including at least one valve and including a control unit communicating with the communication interface, wherein the at least one valve comprises one of a solenoid valve or a rotary valve, and wherein the valve comprises an injection-molding housing, wherein the control modules effect inflation and deflation of cells in the support surface via the valves based on a signal from the communication interface, wherein components of the control modules are housed in a molded module housing, and wherein the injection-molded housing of the valve and the module housing are integrated into a single mold.

2. A distributed pressure control system according to claim 1, wherein the fluid is air.

3. A control system according to claim 1, wherein each of the control modules comprises at least one pressure sensor.

4. A control system according to claim 3, wherein the control unit comprises a processor communicating with the main controller via the communication interface and communicating with the at least one valve and the pressure sensor, the control unit controlling the at least one valve to inflate or deflate a respective one or a respective group of the cells in the support surface based on the signal from the communication interface and a pressure detected by the pressure sensor.

5. A control system according to claim 1, wherein the at least one valve is one of a 2-way valve or a 3-way valve.

6. A control system according to claim 1, wherein the main controller comprises a user interface enabling operator control of distributed pressure.

7. A mattress comprising:

a plurality of cells connected together to define a support surface, at least two of the cells being independently inflatable and deflatable; and a distributed pressure control system, the control system comprising:

a main controller including a source of pressurized fluid and a communication interface, a fluid manifold having a fluid inlet coupled with the fluid source and a plurality of fluid outlets, and a plurality of control modules, each attachable to a respective one of the plurality of fluid outlets, each control module including at least one valve and including a control unit communicating with the communication interface, wherein the at least one valve comprises one of a solenoid valve or a rotary valve, and wherein the valve comprises an injection-molded housing, wherein the control modules effect inflation and deflation of the cells in the support surface via the valves based on a signal from the communication interface, wherein components of the control modules are housed in a molded module housing, and wherein the injection-molded housing of the valve and the module housing are integrated into a single mold.

8. A mattress according to claim 7, wherein the fluid is air.

9. A mattress according to claim 7, comprising a control module for each of the cells, wherein each of the cells is independently inflatable and deflatable.

10. A mattress according to claim 9, wherein each of the control modules identifies a location of its respective cell to the main controller.

11. A mattress according to claim 7, comprising a control module for each group of the cells, wherein each group of the cells is independently inflatable and deflatable.

12. A mattress according to claim 7, wherein the source of pressurized fluid comprises a source of vacuum pressure, and wherein deflation of the cells via the control modules comprises at least one of deflation of an inflated cell and deflation of a cell via the vacuum pressure.

13. A mattress according to claim 7, wherein one of the plurality of control modules is respectively coupled with each of the independently inflatable and deflatable cells that define the support surface.

* * * * *